US006501277B1

(12) United States Patent
Sybesma

(10) Patent No.: US 6,501,277 B1
(45) Date of Patent: Dec. 31, 2002

(54) AUTOMOTIVE HARNESS AND AUDIO SYSTEM ANALYZER

(76) Inventor: Henry William Sybesma, 501 W. 17th St., Holland, MI (US) 49423

( * ) Notice: Subject to any disclaimer, the term of this patent is extended or adjusted under 35 U.S.C. 154(b) by 164 days.

(21) Appl. No.: 09/689,183

(22) Filed: Oct. 12, 2000

Related U.S. Application Data

(60) Provisional application No. 60/158,748, filed on Oct. 12, 1999.

(51) Int. Cl.[7] ..... G01R 31/00; G01R 31/08; H04R 29/00

(52) U.S. Cl. ..... 324/503; 324/524; 381/58

(58) Field of Search ..... 324/503, 524, 324/527, 133, 542, 513; 381/58, 59; 340/652

(56) References Cited

U.S. PATENT DOCUMENTS 3,609,535 A * 9/1971 Paine et al. ..... 324/513
4,100,380 A * 7/1978 Gosswiller ..... 340/652
4,110,571 A * 8/1978 Hills ..... 324/542
4,163,936 A * 8/1979 Shufro ..... 324/133
4,540,940 A * 9/1985 Nolan ..... 324/133
5,361,305 A * 11/1994 Easley et al. ..... 381/58
5,367,250 A * 11/1994 Whisenand ..... 324/133
5,635,843 A * 6/1997 Borland ..... 324/133

* cited by examiner

*Primary Examiner*—Christine Oda
*Assistant Examiner*—Anjan K. Deb
(74) *Attorney, Agent, or Firm*—King & Jovanovic, PLC

(57) ABSTRACT

An apparatus for diagnosing automobile audio systems having a system integrity analyzer which includes speaker testing. The speaker testing includes a member for supplying an input to each of the positive and negative leads while supplying ground to the other of the positive and negative lead. This, in turn, facilitates diagnosis of the operation of the audio system of the vehicle. In addition, the apparatus comprises a system for analyzing vibrations comprising a frequency transmitter and an oscillator. The frequency transmitter is capable of transmitting a signal generated by the oscillator on a frequency that is receivable by a vehicle audio system. The oscillator includes altering the signal generated by the oscillator between the lower audible range and the upper audible range.

15 Claims, 7 Drawing Sheets

AUTOMOTIVE HARNESS AND AUDIO SYSTEM ANALYZER

This application claims the benefit of U.S. Provisional Patent Application Serial No. 60/158,748 filed Oct. 12, 1999, the entire specification of which is incorporated herein by reference.

BACKGROUND OF THE INVENTION

1. Field of the Invention

The present invention relates in general to electric and/or electronic analysis units, and more particularly, to automotive harness and audio system analyzers which are capable of analyzing and diagnosing problems associated with automotive wiring systems as well as automotive audio head units.

2. Background Art

Today's automobiles are generally equipped with factory installed complex audio systems. Such audio systems generally include one or more speakers, a head unit, amplifiers and a wiring harness. The head unit (which generally includes a radio, a CD and/or a tape player) and the amplifiers are generally expensive units to replace.

As with other automotive components, the audio systems of certain vehicles can have faulty components or a faulty condition which can render the audio system inoperative or, at the very least, unable to perform according to predetermined specifications. For example, the tape player of the head unit can be faulty while the CD and radio players can be fully operational. Similarly, three of the four speakers can be fully operational, while a fourth speaker can be defective. Furthermore, while the components may be operational, the wiring may be improperly grounded or a connection can become desoldered.

Generally, when a faulty condition is recognized in a vehicle, the service center immediately replaces one or more of the main components, namely, the head unit, the amplifier and/or one or more of the speakers. Due to the complex nature of the vehicle audio system, comprehensive diagnosis is rarely performed at the service center; rather components are merely replaced. As a result of this replacement procedure, many of the components that the service center replaces are not faulty, but are instead fully operational. Inasmuch as these repairs are performed, generally under warranty, the automotive manufacturer or the component manufacturer ultimately covers the cost of the replacement of non-faulty parts.

In addition, even where the components are generally operational, the audio system can send sounds through the speakers which produce a discernable unwanted vibration in one of the components. Since the vibration is generally caused by sound produced by the speakers at a particular frequency, the sound cannot be easily replicated by a technician in the service center.

Accordingly, it is an object of the invention to develop a system that individually tests the components of an audio system to diagnose problems associated with the system.

It is another object of the invention to provide a system by which to transmit audio signals through the audio system at various frequencies to determine and diagnose any particular frequencies which may cause unwanted vibration within the vehicle.

These and other objectives of the invention will become apparent in light of the present specification, drawings, and claims appended hereto.

BRIEF DESCRIPTION OF THE DRAWINGS

The invention will now be described with reference to the drawings wherein.

DETAILED DESCRIPTION OF THE PRESENT INVENTION

Figure 1:
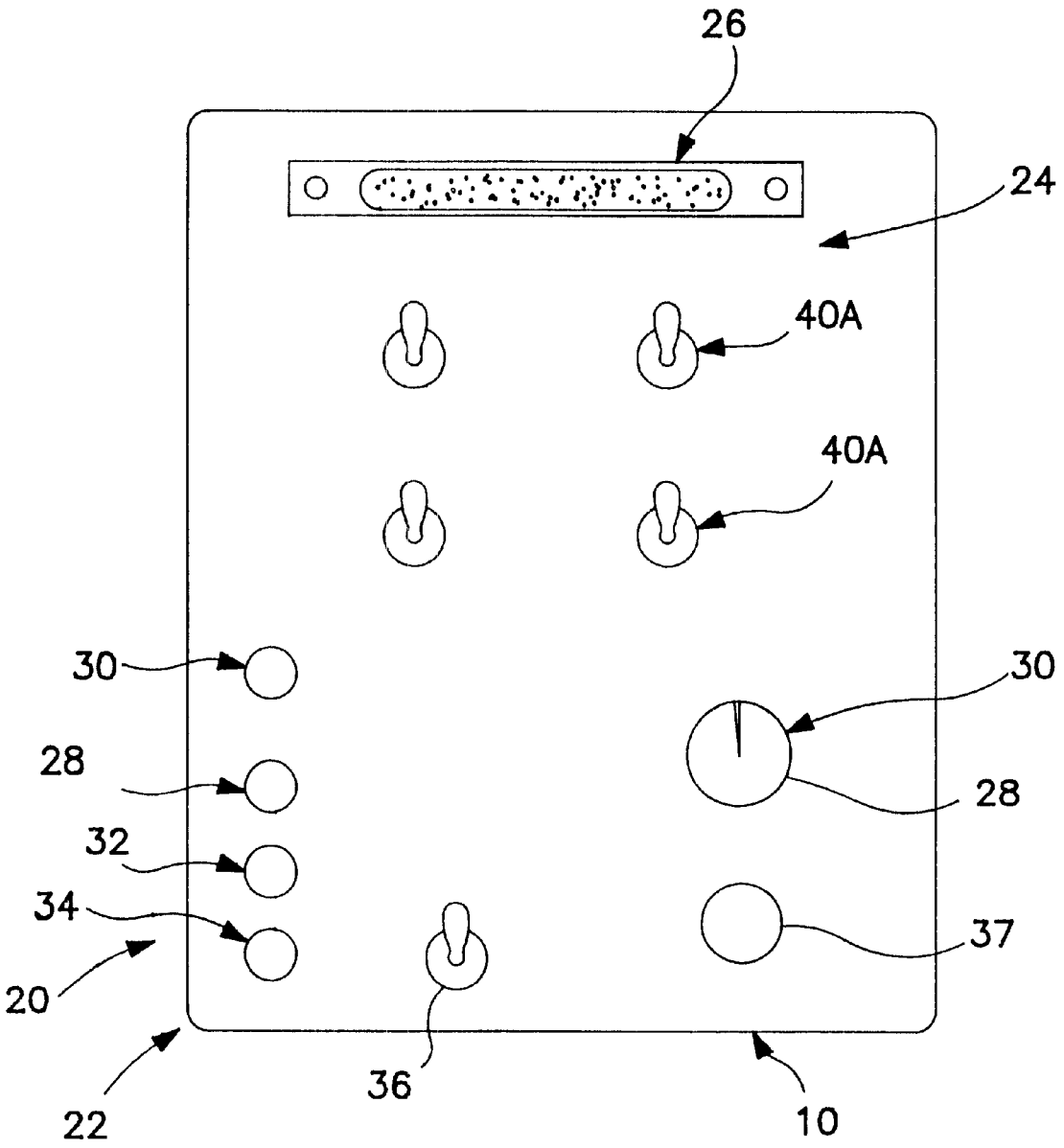
FIG. 1 of the drawings is a top perspective view of an analog embodiment of an automotive harness and audio system analyzer in accordance with the present invention.

While the present invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Automotive harness and audio system analyzer 10 is shown in FIG. 1 as system integrity analyzer (SIA) 20 and vibration analyzer (VA) 30. In particular, the analyzer is shown in FIG. 1 as a single component including both the SIA and VA whereas in FIG. 6 and FIG. 7 they are shown as separate components. In addition, while the components are shown as comprising analog circuitry, it is likewise contemplated that the system may comprise a digital analyzer (FIG. 5) in which some digital circuitry may be utilized in place of the analog circuitry. The digital circuitry may be used to provide a more user friendly interface for the system. In addition, when utilizing the digital circuitry, the SIA and VA may utilize a single microcontroller which can provide a measurable degree of cost savings.

Figure 6:
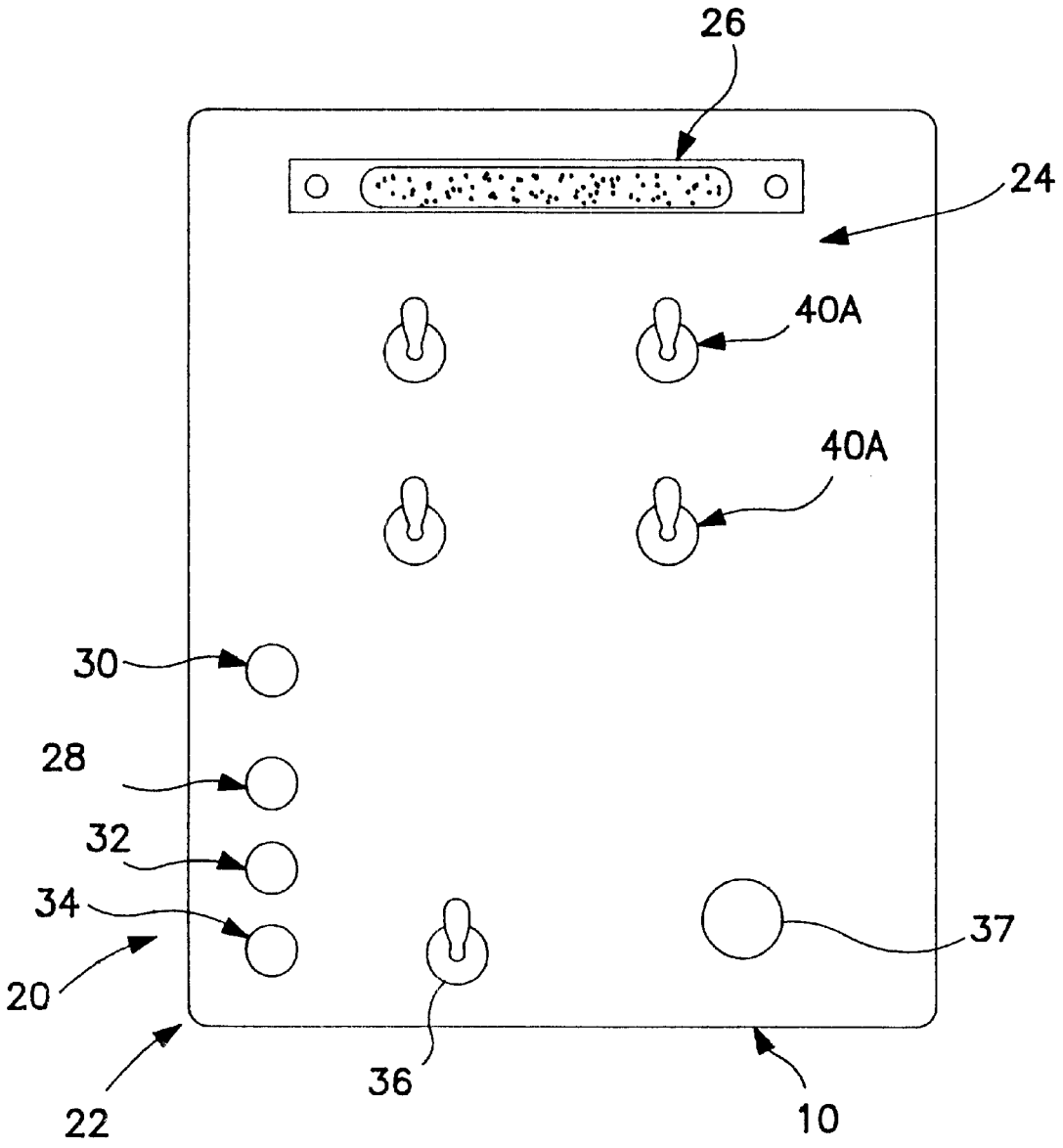
FIG. 6 of the drawings is a top perspective view of an analog embodiment of a system integrity analyzer in accordance with the present invention.

System integrity analyzer 20 as shown in FIGS. 1 and 6, includes system analyzer means 22, speaker test means 24 and connector means 26. System analyzer means 22 includes headlight signal 28, mute indicator 30, ignition indicator 32, battery indicator 34, antenna/amplifier indicator 36 and dimmer indicator 37. The various system analyzer means 22 verify and provide feedback to the user to determine that certain conditions are prevalent. As will be explained in detail below with respect to the operation of SIA 20, the indicators light-up when a predetermined condition is satisfied. For example, when the system analyzer means is attached to the wire harness of the audio system and battery power is sensed by the system, battery indicator 34 lights-up. The other indicators will be explained below.

Figure 2A:
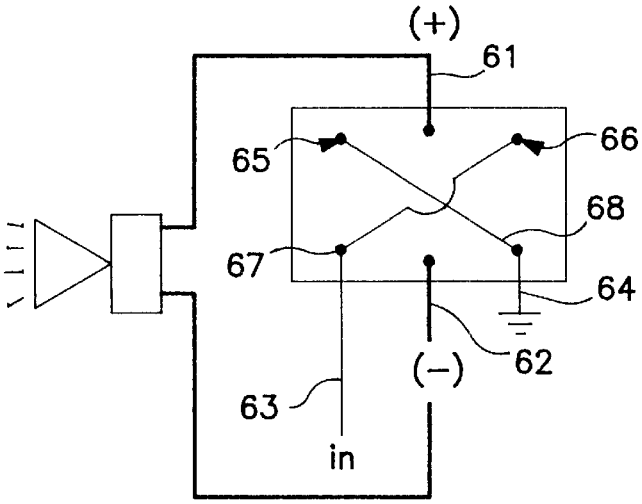
FIG. 2A is a schematic diagram of a switch of the speaker test means.
Figure 2B:
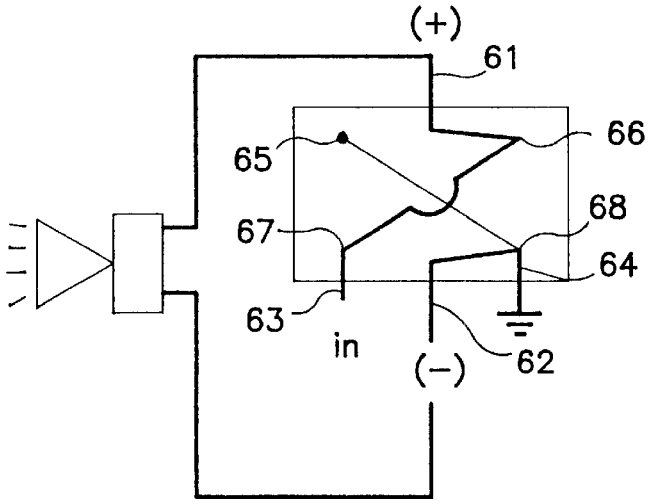
FIG. 2B is a schematic diagram of a switch of the speaker test means in a first position.
Figure 2C:
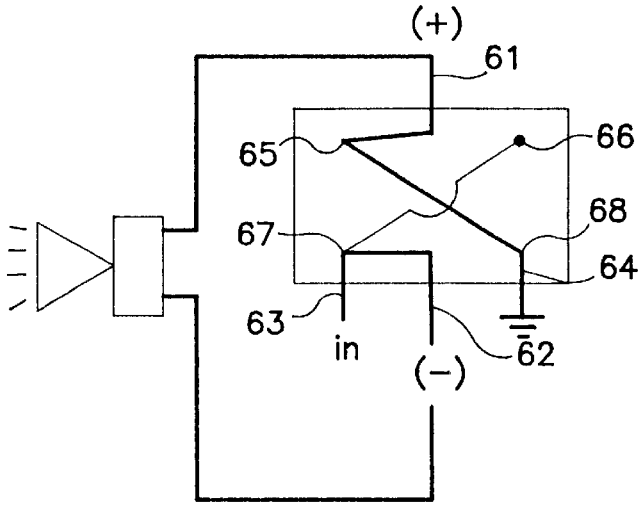
FIG. 2C is a schematic diagram of a switch of the speaker test means in a second position.

Speaker test means 24 includes switches, such as switches 40A, which are shown in schematic form in FIGS. 2A–2C, sound generator 50 (FIG. 4) and clips (not shown). The number of switches will generally depend on the number of speakers associated with the system. In the embodiment shown, the speaker test means 24 includes four switches 40A which can simultaneously test four speakers. One of switches 40A will be explained with the understanding that the other switches are substantially identical.

For purposes of the present disclosure, switch 40A is shown in FIGS. 2A–C as comprising positive speaker lead 61, negative speaker lead 62, input 63 and ground 64, along with pins 65–68. As can be seen, pins 66 and 67 are wired together and to input 63. Similarly pins 65 and 68 are wired together and to ground 64. Accordingly, when switch 40A is thrown to position 1 (FIG. 2B), the positive lead is contacted with pin 66 and the negative lead is associated with pin 68. In this case input 63 is directed to positive lead 61 and the negative lead 62 is associated with ground 64. When the switch is thrown into position 2 (FIG. 2C), the positive lead is contacted with pin 65 and the negative lead is associated with pin 67. In such a position, the negative lead 62 is associated with input 63 and the positive lead is associated with ground 64. Conventional alligator clips can be utilized to bypass the wire harness and to attach directly to the speaker itself. As will be explained, such clips are useful to troubleshoot the speaker and the wire harness leading to a particular speaker.

Figure 4:
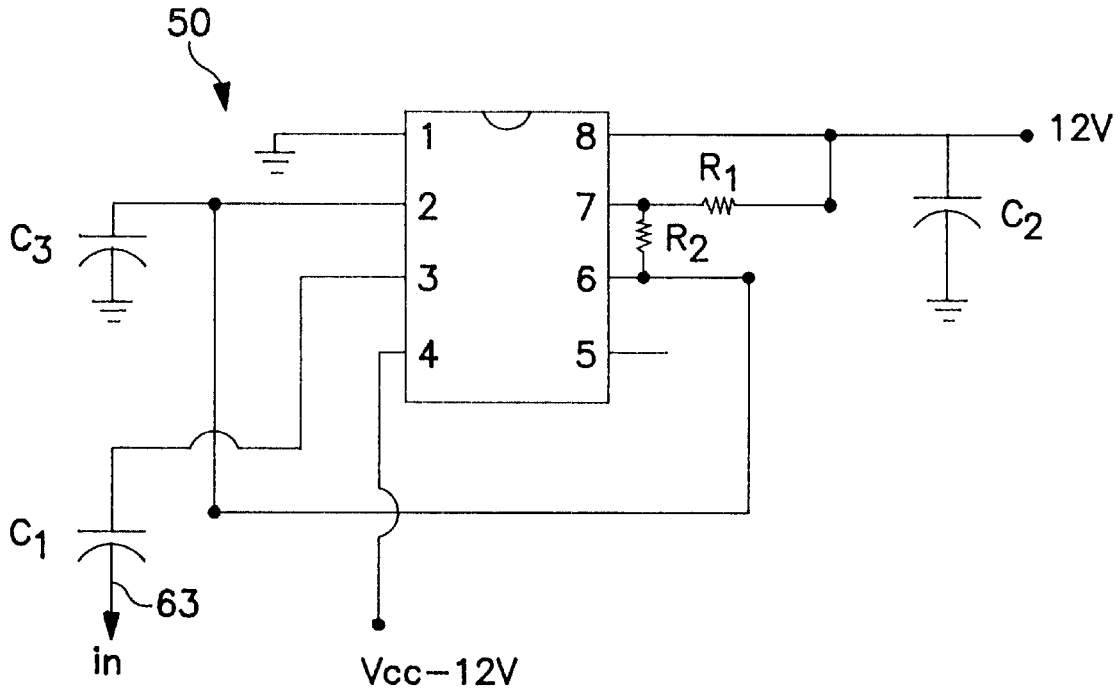
FIG. 4 is a schematic diagram of a 555 counter circuitry of the present invention.

Sound generator 50 is shown in FIG. 4 and comprises a 555 counter, while other counters and other analog circuits are contemplated for use. Of course, in a digital environment, a frequency generator in combination with the microcontroller can be utilized in the place of a 555 counter. 555 counter is used in combination with capacitors C1–C3, resistors R1–R2 and voltage supply. In particular, a voltage of 12 volts is applied to pins 4 5 and 8. Of course, other voltages are contemplated for use with particular applications, however, the automotive industry has generally accepted a standardized voltage for automobiles of 12 volts. In such an embodiment, C2 is utilized to filter the voltage, to insure that a voltage of 12 volts is transmitted to pin 8. A capacitor of such having a capacitance of 470 microfarads and an operating voltage of 25 volts can be utilized, while others are likewise contemplated for use. Capacitor C1 limits any return voltage which may return from the output and prevents overheating of the 555 counter. Typical values for such a capacitor are 1 microfarad and an operating range of 16 volts. Of course, others are likewise contemplated. R1, R2 and C3 are utilized to generate the desired output. The values selected for R1, R2 and C3 are 56 k ohms, 1 k ohms and 0.033 microfarads at a rating of 16 volts. Of course other values can be utilized which will then affect the output signal that is achieved. The output from the sound generator 50 is directed into input 63 of switch 40.

Figure 7:
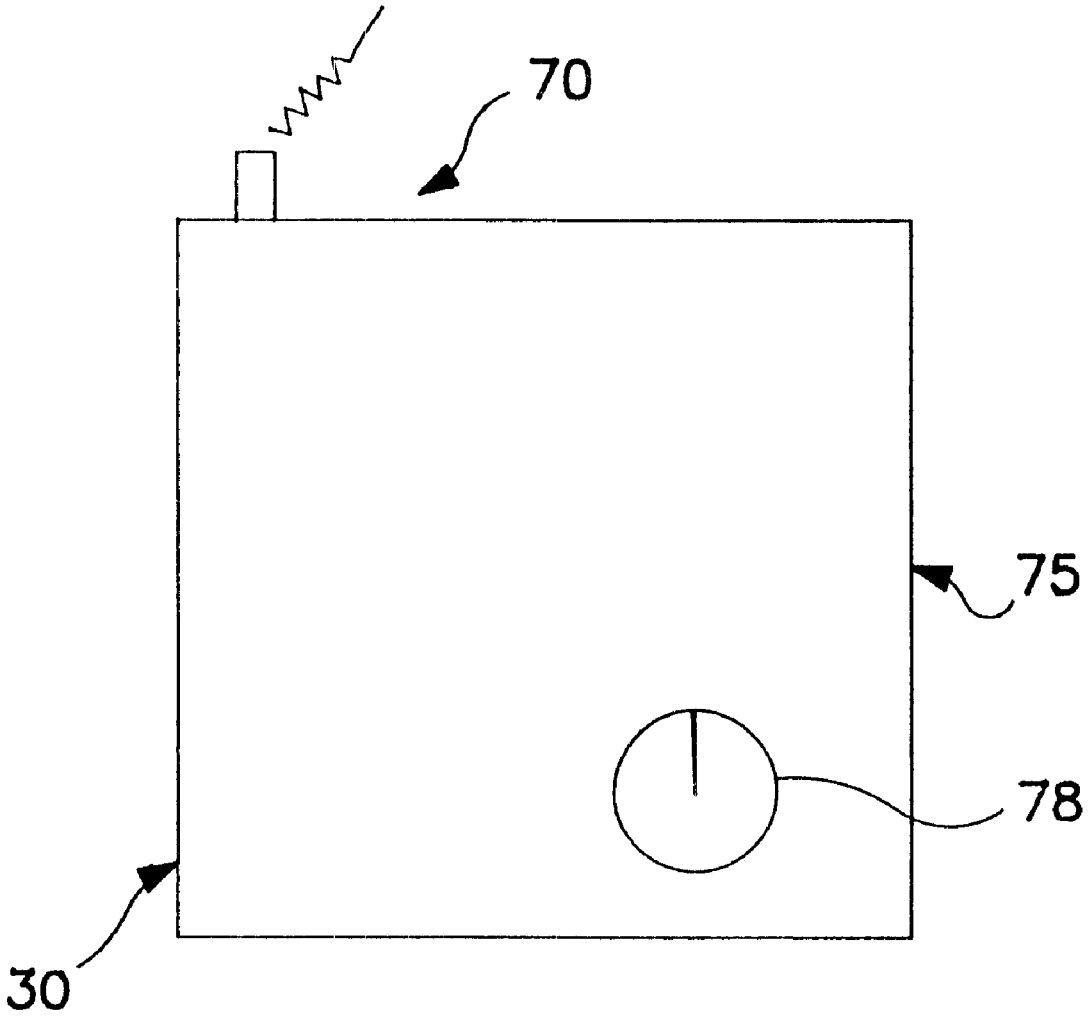
FIG. 7 of the drawings is a top view of an embodiment of the vibration analyzer of the present invention.

Connector means 26 as shown in FIG. 1 comprises a pin interface which is suited for attachment of the wire harness of the vehicle audio system with the system integrity analyzer. The connector means may comprise a cable which has one end suited for attachment to a particular vehicle wire harness (custom for different car manufacturers) and suitable for attachment at the other end to analyzer 20. While other designs are contemplated, for simplicity, a 25 pin connector is utilized on system integrity analyzer 20. As shown in FIG. 7, vibration analyzer 30 comprises frequency transmitter 70 and oscillator 75. Frequency transmitter 70 and oscillator 75 are electrically linked so that frequency transmitter 70 transmits a signal which is generated by oscillator 75 over a particular frequency. The frequency of the applied signal can be manipulated by the user by rotating knob 78 associated with oscillator 75. Oscillator 75 is selected so that it can generate a signal which extends from the lower audible range of 20–40 Hz to the upper range in excess of 30,000 Hz. As the knob is rotated, the frequency increases or decreases, depending on the direction of rotation. Of course, various systems for changing the signal other than a rotary knob are likewise contemplated for use. Frequency transmitter 70 is selected which transmits a frequency that is in the U.S. FM range (or, a foreign equivalent). Of course, a digital vibration analyzer can likewise be formed according to the principles of the invention, and the particular circuitry can be determined by one of ordinary skill in the art having the present disclosure before them.

Figure 5:
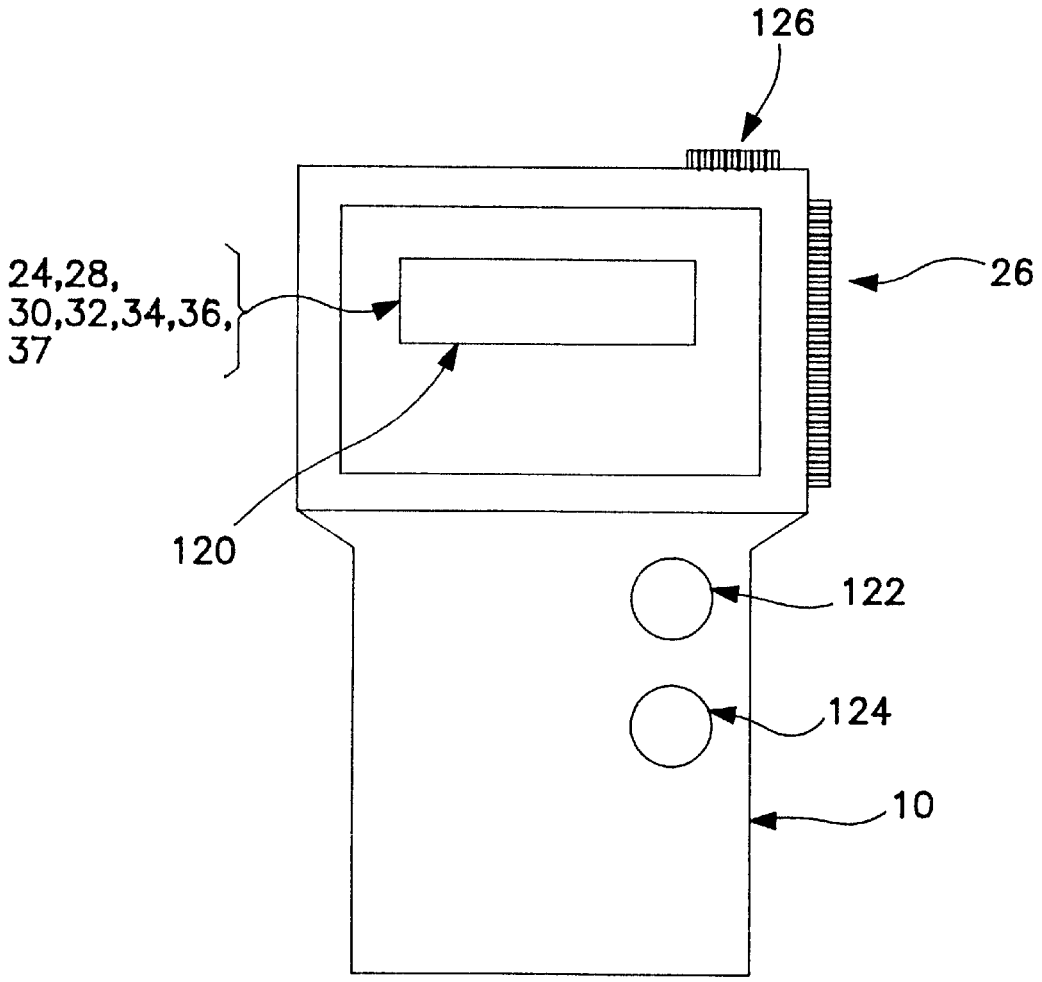
FIG. 5 of the drawings is a top perspective view of a digital embodiment of an automotive harness and audio system analyzer in accordance with the present invention.

The digital embodiment of the automotive harness and audio system analyzer 10 is shown in FIG. 5. The digital embodiment includes display 120, scroll member 122, select member 124 and connectivity connector 126. The operation of the digital embodiment is controlled by a software program. The program can be embedded onto ROM, or, in the alternative, the program may be embedded on flash memory, which can be accessed by connectivity connector 126. The user operates the digital embodiment by making selections from menu's presented on display 120, through use of the scroll member 122 and the select member 124.

The operation of the digital embodiment is substantially similar to that of the analog embodiment. However, the digital embodiment includes an improved interface for the user, and the software has the ability to be reprogrammed by way of connectivity connector. As such, as additional tests become necessary, or as wiring harnesses change, only the software requires updating. It will be understood that one of skill in the art having the present disclosure before him, would be able to properly design the digital circuitry for the digital embodiment of the invention.

In operation, the operator proceeds to a vehicle with automotive harness and audio system analyzer 10. The operator first determines the condition of the automotive audio system. Specifically, the user determines if the auto has 1) vibration problems due to the speaker output; or 2) audio system malfunction. If the audio system is creating unwanted vibrations, the operator activates vibration analyzer 30 of automotive harness and audio system analyzer 10. Once activated, the operator tunes the radio to the particular frequency that frequency transmitter 70 is tuned. For example, the frequency may comprise 88.9 MHz. Once tuned to that particular frequency, the operator can raise the volume of the radio to hear the signal that is transmitted by frequency transmitter 70 and generated by oscillator 75. Next, the operator rotates knob 78, or other signal altering means, and the signal that is transmitted through the radio changes in frequency (up or down, depending on the direction of rotation). The operator rotates knob 78 until the entire audible range has been tested. If the automobile has a loose component or one that is not properly installed, and which will vibrate during operation of the audio system of the automobile, as the user rotates knob 78, the particular resonant frequency of the loose component will be reached, and the component will begin to vibrate. The user can then isolate the component and correct the problem so that the component is secured and no longer vibrates at that frequency—or at any other utilized frequency. Once the entire audible range has been tested, the automobile is then free of unwanted vibrations caused by the audio system. In one embodiment (such as the digital embodiment of FIG. 5), display 120 may identify the frequencies as the test is proceeding so that a user can determine and record the frequencies at which vibration is observed. This information can then be shared with other users.

If, instead, the operator is informed of a malfunction in the audio system, the operator first removes the head unit (radio tuner, CD and/or tape player). Once removed, the operator attaches the wire harness that previously was attached to the radio, to system integrity analyzer 20. In particular, the wire harness of the audio system is attached to a cable which is attached to connector means 26. Once connected, the user reviews system analyzer means. With the vehicle off, only the battery indicator should be activated, indicating that power is being supplied to the head unit memory and settings. Once the ignition is turned to the accessory setting, or the vehicle is turned on, the ignition indicator should light-up. Next, as the lighting system of the vehicle is activated, the headlight indicator should be activated to identify that the lighting system is receiving a signal from the auto headlamp circuitry. If the system includes an audible computer or a cellular phone that is integrated with the automobile, the vehicle is capable of sending a mute signal to the radio, if for example, the computer wants to warn the user of a condition audibly. Inasmuch as none of such systems should be active, the mute indicator should not be activated. As the user adjusts the dimmer switch of the vehicle, the dimmer indicator should likewise reflect the change to the intensity of the lighting, indicating that the dimmer signal is being transmitted to the audio system. Lastly, the user can activate the antenna or amplifier with antenna/amplifier indicator 36 to determine the proper operation of each.

If any of the foregoing signals are not received by the unit, the respective indicator will deactivate, indicating that there is a problem in the harness. For example, if, after the unit is connected to the wire harness, the battery indicator remains deactivated, then the operator will understand that the audio system is not receiving the constant battery power which maintains memory and settings. Similarly, if the headlight indicator remains deactivated after the headlights have been turned on, the operator is informed that the headlight switch signal is not being transmitted to the audio harness (i.e., the lead from the headlight switch is cut or improperly grounded). In this manner, the operator can test the functionality of the harness to determine if the proper signals are being sent to the head unit.

Once these systems have been verified, the operator can test the circuit leading to the speakers. Switch 40A provides a means for selectively connecting the terminals of a speaker to voltage or to ground. Specifically, to operate the selective connecting means, the user first switches the first switch 40A to the first position (FIG. 2B), then to the second position (FIG. 2C). In the first position, voltage is applied to the positive lead, and ground is attached to the negative lead. In the second position, voltage is applied to the negative lead and ground is attached to the positive lead. An audible tone should be heard in each position. If a tone is not heard in one or more of the positions, the operator can then further investigate the issue by isolation using conventional alligator clips. Specifically, the first condition is if an audible tone is heard in both switch positions. In this case, the wire harness and the speaker appear to be fully operational.

Figure 3A:
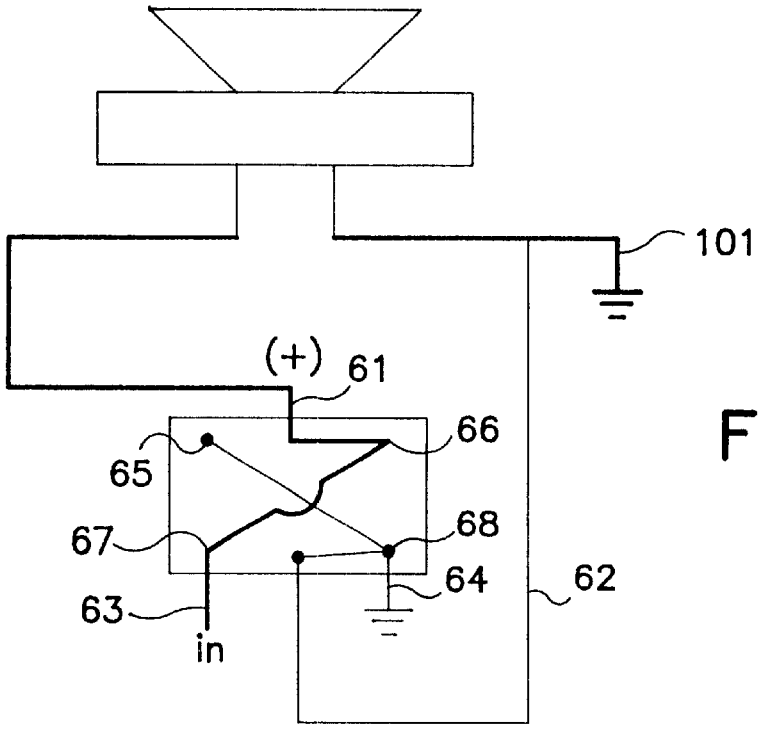
FIG. 3A is a schematic diagram of the switch associated with a defective speaker wherein the switch is in a first position.
Figure 3B:
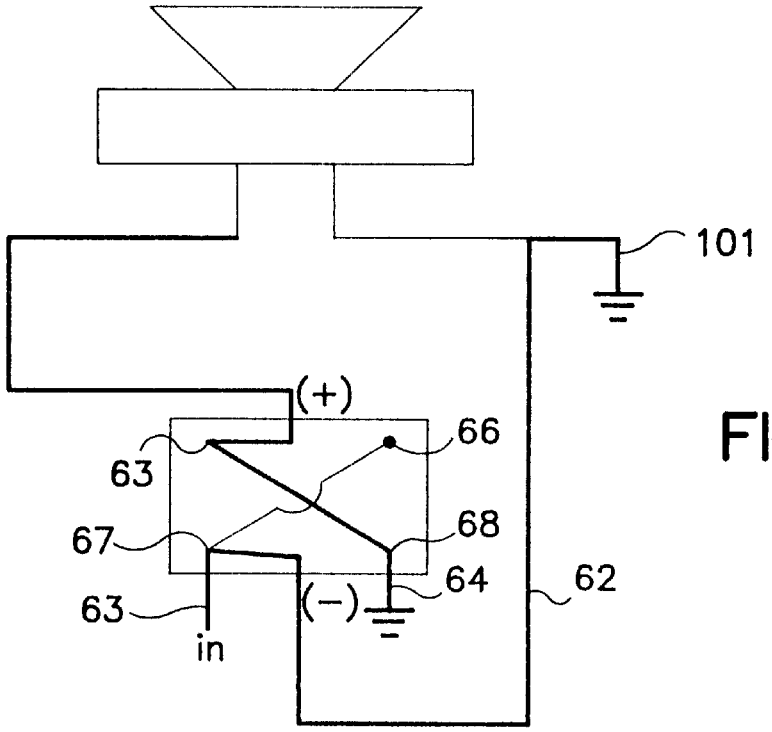
FIG. 3B is a schematic diagram of the switch associated with a defective speaker wherein the switch is in a second position.

In the second condition, an audible tone is heard in one switch position but not in the other switch position. This condition is shown in detail in FIGS. 3A and 3B. Specifically, in this case, one of the two leads to the speaker is inadvertently grounded. As shown in FIG. 3A, inadvertent ground 101 in negative lead 62 with the switch in the first position, will yield an audible sound (i.e., the circuit is complete). However, as shown in FIG. 3B, in the second position, the inadvertent ground precludes the formation of a complete circuit, and, as such, the speaker will yield no audible sound. In this condition, the operator can track down the inadvertent ground, or the user can simply replace the wiring to that particular speaker.

In the third condition, no audible tone is heard in either switch position. In this case, VP the operator is essentially told that there is a problem with either the wiring or the speaker itself. In this case, the user attaches clips directly to the speaker. If an audible tone can be heard, then the operator knows that the wiring requires replacement since there is an break in the wiring. If, on the other hand, no audible signal is heard, then the operator knows that the speaker itself is faulty. Once the speaker is replaced, the operator should retest the speaker to determine that the wiring is not faulty, since it is possible to have both faulty wiring and a faulty speaker.

Such a device is particularly useful in systems that use devices such as bridge audio output which applies a positive 6 volts to the positive lead and a negative 6 volts to the negative lead. Such systems, which are rather popular in automobiles today provide a challenge for a service center to diagnose. Instead of complicated diagnosis, operators have proceeded to replace all components, other than wiring, at considerable expense to the automotive or audio product manufacturer. With the foregoing device, the operator is capable of diagnosing the problem in the audio system, thereby facilitating only replacement of the faulty components. Currently, it is estimated that without the proper diagnostic equipment, service centers are replacing millions of dollars of components which are fully operational.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An apparatus for diagnosing automobile audio systems, comprising:

a system integrity analyzer including means for testing at least one speaker, the speaker test means comprising:

at least one positive output placeable in electrical communication with the positive input of a speaker;

at least one negative output placeable in electrical communication with the negative input of a speaker;

a first means for electrically connecting the at least one positive output to a signal source and the at least one negative output to ground;

a second means for electrically connecting the at least one positive output to ground and the at least one negative output to a signal source;

means for selectively activating one of the first and second electrical connecting means.

2. The apparatus of claim 1 wherein the first and second electrical connecting means and the selective activation means comprise a two position switch, wherein the positioning of the switch into a first position activates the first electrical connecting means, and the positioning of the switch into a second position activates the second electrical connecting means.

3. The apparatus of claim 1 wherein the system integrity analyzer further includes;

means for connecting the system integrity analyzer to a wiring harness of a vehicle; and means for analyzing the audio system.

4. The apparatus of claim 3 wherein the audio system analyzing means includes any one or more of the group consisting of: headlight signal indicator, mute indicator, ignition indicator, battery indicator, antenna indicator, amplifier indicator and dimmer indicator.

5. The apparatus of claim 3 wherein the at least one positive output and the at least one negative output are integrated within the connecting means.

6. The apparatus of claim 1 wherein the system includes a plurality of speaker test means, each speaker test means associated with a particular speaker of a vehicle.

7. The apparatus of claim 1 further comprising a vibration analyzer.

8. The apparatus of claim 7 wherein the vibration analyzer comprises:

a transmitter;

a oscillator capable of generating a plurality of signals over a range of frequencies, the oscillator associated with the transmitter, wherein the transmitter is capable transmitting the signal generated by the oscillator.

9. The apparatus of claim 8 wherein the transmitter is set to a frequency corresponding to the FM frequency range.

10. The apparatus of claim 8 wherein the oscillator is capable of generating signals in the range of 20 Hz to 30,000 Hz.

11. A method for diagnosing the operation of a speaker comprising the steps of:

providing a first output;

electrically connecting the first output to a first terminal of the speaker;

providing a second output;

electrically connecting the second output to a second terminal of the speaker;

applying a signal to the first output;

applying a ground to the second output;

detecting the condition of the circuit;

disconnecting the first and second outputs;

applying a signal to the second output; and applying a ground to the first output; and detecting the condition of the circuit.

12. The method of claim 11 further comprising a switch electrically associated with the first and second outputs, the step of applying a signal to the first output and a ground to the second output comprises the step of positioning the switch into a first position; and the step of applying a signal to the second output and a ground to the first output comprises the step of positioning the switch into a second position.

13. A method for diagnosing an audio system of a vehicle comprising the steps of:

associating the wiring harness of a vehicle with a system integrity analyzer;

determining the receipt of power from the battery of the vehicle to the analyzer;

determining the receipt of any one or more of the following signals:

a headlight signal from the vehicle to the analyzer;

a mute signal from the vehicle to the analyzer;

an ignition indicator from the vehicle to the analyzer;

an antenna indicator from the vehicle to the analyzer; and a dimmer indicator from the vehicle to the analyzer; and determining the condition of at least one speaker, comprising the steps of:

applying a signal to the speaker in a first direction;

determining the condition of the circuit;

applying a signal across the speaker in a second direction; and determining the condition of the circuit.

14. The method of claim 13 wherein the step of determining the condition of at least one speaker comprises the step of determining the condition of each speaker associated with the vehicle.

15. A method of vibration testing an audio system of a vehicle comprising the steps of:

generating a signal within the audible range;

transmitting the signal over a predetermined frequency;

receiving the signals on a predetermined frequency on a vehicle radio;

altering the signal through the audible range; and noting any vibrations as the signal is altered through the audible range.

* * * * *